US008899223B2

(12) United States Patent
Cadima

(10) Patent No.: US 8,899,223 B2
(45) Date of Patent: Dec. 2, 2014

(54) HOT SURFACE IGNITER SHIELD FOR A GASEOUS FUEL APPLIANCE

(75) Inventor: Paul Bryan Cadima, Prospect, KY (US)

(73) Assignee: General Electric Company, Schenectady, NY (US)

( * ) Notice: Subject to any disclaimer, the term of this patent is extended or adjusted under 35 U.S.C. 154(b) by 545 days.

(21) Appl. No.: 13/249,369

(22) Filed: Sep. 30, 2011

(65) Prior Publication Data

US 2013/0081611 A1 Apr. 4, 2013

(51) Int. Cl.
*F24C 3/10* (2006.01)
*F23Q 7/22* (2006.01)

(52) U.S. Cl.
CPC .. *F23Q 7/22* (2013.01); *F24C 3/103* (2013.01)
USPC ..... 126/39 E; 126/39 R; 126/39 BA; 126/258; 431/258; 431/263

(58) Field of Classification Search
CPC ..... F23D 2207/00; F23Q 3/00; F23Q 7/00; F24C 3/10; F24C 3/103; F24C 3/126
USPC ..... 126/39 E, 39 R, 39 BA, 258, 25 B; 431/258, 263, 259, 264
See application file for complete search history.

(56) References Cited

U.S. PATENT DOCUMENTS

| | | | | |
|---|---|---|---|---|
| 3,823,345 | A | 7/1974 | Mitts et al. | |
| 4,029,936 | A | 6/1977 | Schweitzer | |
| 5,856,651 | A | 1/1999 | Shaffer | |
| 6,935,328 | B2 | 8/2005 | Haynes et al. | |
| 7,786,409 | B2 * | 8/2010 | Hamel et al. | 219/267 |
| 2005/0053884 | A1 * | 3/2005 | Schmiedlin et al. | 431/263 |

* cited by examiner

*Primary Examiner* — Avinash Savani
(74) *Attorney, Agent, or Firm* — Dority & Manning, P.A.

(57) ABSTRACT

A gas burner assembly is provided that has a hot surface igniter. The hot surface igniter is equipped with a shield that protects the igniter from e.g., impact or other damage during cleaning or use. The shield is configured with the gas burner in a manner that can minimize the aesthetic impact on the flame while also providing ignition at low and high gas flow rates.

19 Claims, 4 Drawing Sheets

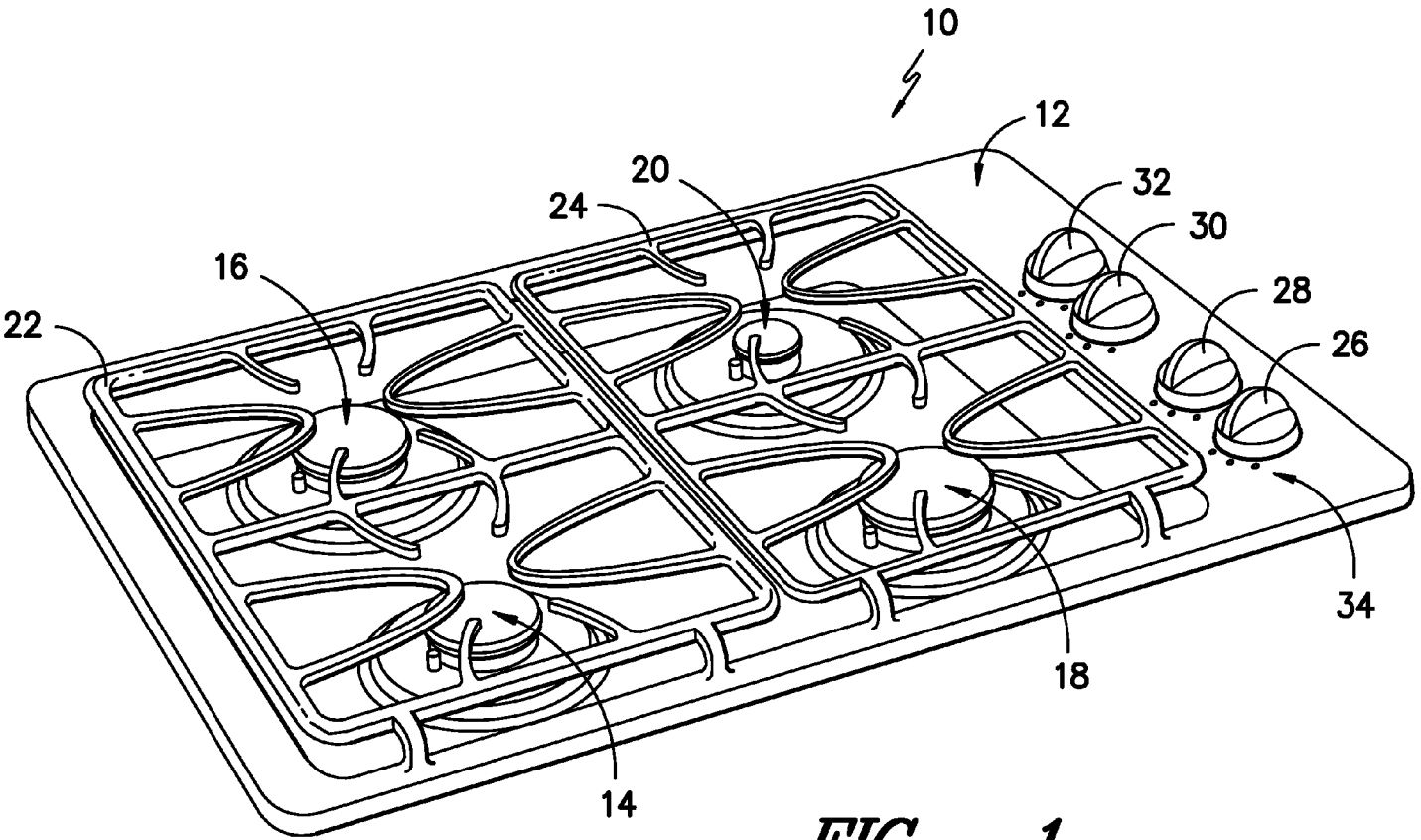
FIG. —1—

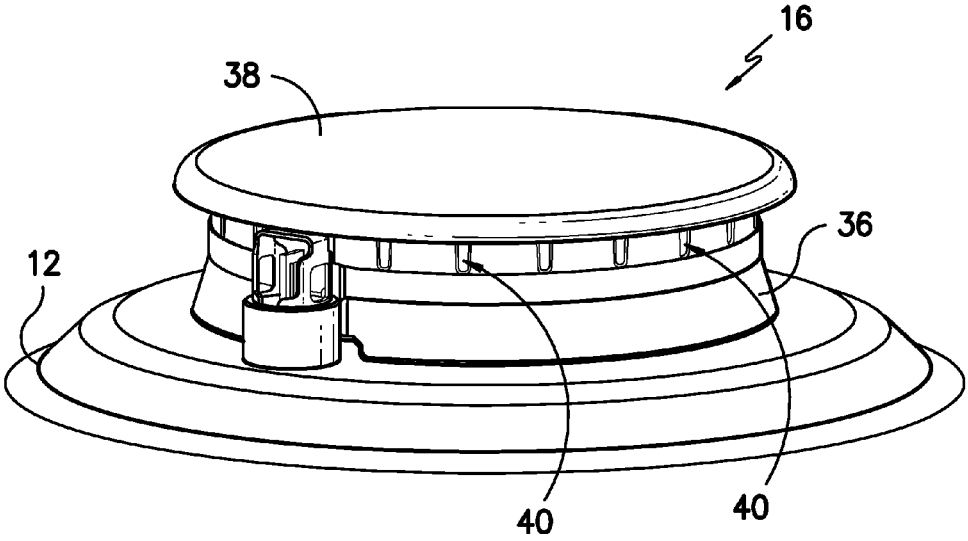
FIG. –2–
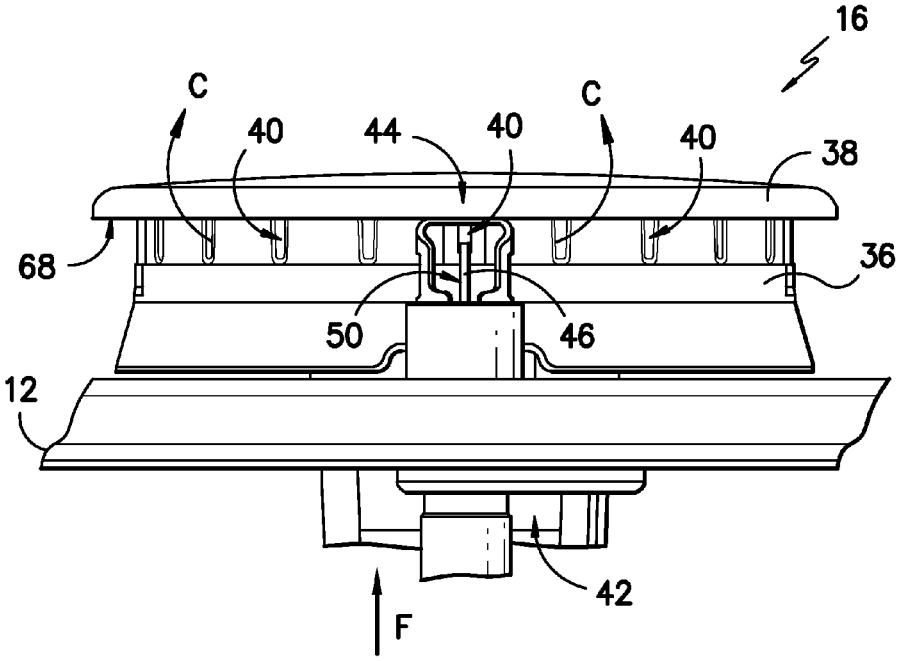
FIG. –3–

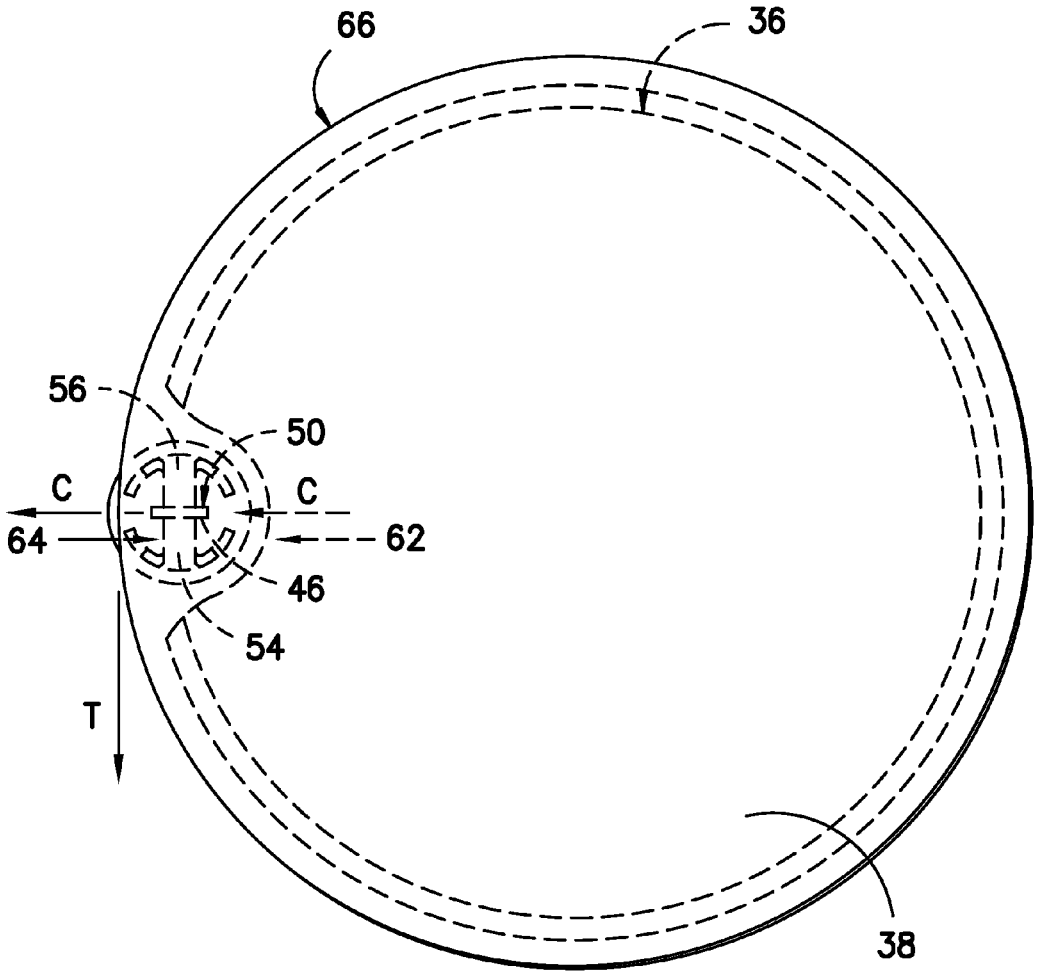
FIG. –5–

HOT SURFACE IGNITER SHIELD FOR A GASEOUS FUEL APPLIANCE

FIELD OF THE INVENTION

The subject matter of the present invention relates to a hot surface igniter shield for a gas fuel appliance.

BACKGROUND OF THE INVENTION

Gas-based, cook top appliances generally include a device for igniting the gas fuel once a valve is opened to supply fuel to the gas burner. One type of igniter relies on the generation of a spark to ignite the fuel. The spark is created electrically through a voltage discharge between two conductors positioned near the burner. Another type, commonly referred to as a hot surface igniter, relies on generating sufficient heat on its surface to ignite gas supplied to the gas burner. Typically, the hot surface is made of a ceramic material.

Unfortunately, hot surface igniters can be extremely fragile as the ceramic construction can be very brittle. For applications in e.g., ovens, air heating systems, water heaters, and fireplaces, the igniter can be isolated from the consumer or otherwise easily protected. However, in applications such as a cook top appliance, the fragility of the hot surface igniter can present challenges as the igniter is subject to impact during use and can be more susceptible to contamination than a spark igniter. Impacts during use or cleaning can damage the igniter and require repairs or other servicing.

Additional challenges are also presented with the use of hot surface igniters on cook top appliances. Aesthetic considerations—i.e. the shape and color of the flame created by the burner—are important to consumer perception. The placement of a device near the burner has the potential to change the shape and/or color of the flame. Preferably, the flame is somewhat symmetrical and appears mostly blue in color. The placement of an igniter in the gas flow can cause the flame to lose symmetry and/or burn with a yellowish color—which can be undesirable to some consumers.

Also, modern gas burners typically must operate over a wide range of heat outputs. For example, a gas burner may be required to operate at outputs as high as 20,000 BTU/hour while also operating in a stable manner at outputs as low as 450 BTU/hour. This range is much greater than required for the previously described applications for a hot surface igniter. As the igniter must be capable of igniting the gas fuel at both ends of this range, the igniter must be located near the source of gas fuel in order to be able to provide ignition at low flow rates. However, at high flow rates, the close proximity to the igniter negatively impacts the aesthetic considerations previously mentioned. The presence of the igniter at high gas flow tends to spread out the fuel and cause a large local plume near the igniter. Adding shielding to protect the igniter can exacerbate this aesthetic issue.

Accordingly, a hot surface igniter for the gas burner assembly of a cook top appliance would be useful. More specifically, a hot surface igniter that includes shielding for protection from breaking or other damage would be beneficial. Such an igniter that can also operate at a wide range of gas flows and properly ignite the fuel without unacceptably affecting the appearance of the flame would also be particularly useful.

BRIEF DESCRIPTION OF THE INVENTION

Aspects and advantages of the invention will be set forth in part in the following description, or may be obvious from the description, or may be learned through practice of the invention.

In one exemplary embodiment, the present invention provides a gas burner assembly for connection to a source of gas. The assembly includes a burner body defining an opening for the flow-through of gas. A burner cap is positioned on top of the burner body. The burner cap defines a bottom surface. A hot surface igniter is positioned adjacent to the burner body and beneath the burner cap. A shield is positioned over the hot surface igniter. The shield defines an exit opening and an entrance opening. The shield also defines a planar top surface that is substantially parallel, and positioned in close proximity to, the bottom surface of the burner cap.

In another exemplary embodiment of the invention, a gas fuel cooking appliance is provided that includes a cook top assembly. A gas burner is positioned on the cook top assembly. The gas burner includes a burner body defining an internal passage in communication with a plurality of orifices positioned around a circumference of the burner body and configured for the flow-through of gas supplied through the internal passage. A burner cap is positioned on top of the burner body. The burner cap defines a bottom surface. A hot surface igniter is positioned adjacent to the burner body and below the burner cap. A shield is positioned over the hot surface igniter. The shield defines an exit opening and an entrance opening. The shield also defines a top surface that is positioned immediately below the bottom surface of the burner cap.

In still another exemplary aspect of the present invention, a method for protecting a hot surface igniter is provided. The method includes the steps of providing a gas burner assembly for connection to a source of gas. The gas burner assembly includes a burner body defining an opening for the flow-through of gas; a burner cap positioned on top of the burner body, the burner cap defining a bottom surface; a hot surface igniter positioned adjacent to the said burner body and beneath the burner cap; and, a shield positioned over the hot surface igniter, where the shield defines an exit opening and an entrance opening, and the shield defines a planar top surface that is substantially parallel to the bottom surface of the burner cap. The method further includes the step of positioning the planar top surface of the shield in close proximity to the burner cap so as to maximize the area for flow of gas past the hot surface element and minimize the disturbance of the gas mixture flow through the hot surface igniter.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 1 is a perspective view of an exemplary embodiment of a cooktop appliance as may be used with the present invention.

FIG. 2 provides a perspective view of an exemplary embodiment of gas burner assembly of the present invention.

FIG. 3 is side view of the exemplary embodiment of FIG. 2.

FIG. 5 is top down view of the exemplary embodiments of FIGS. 2 and 3.

DETAILED DESCRIPTION OF THE INVENTION

Figure 4:
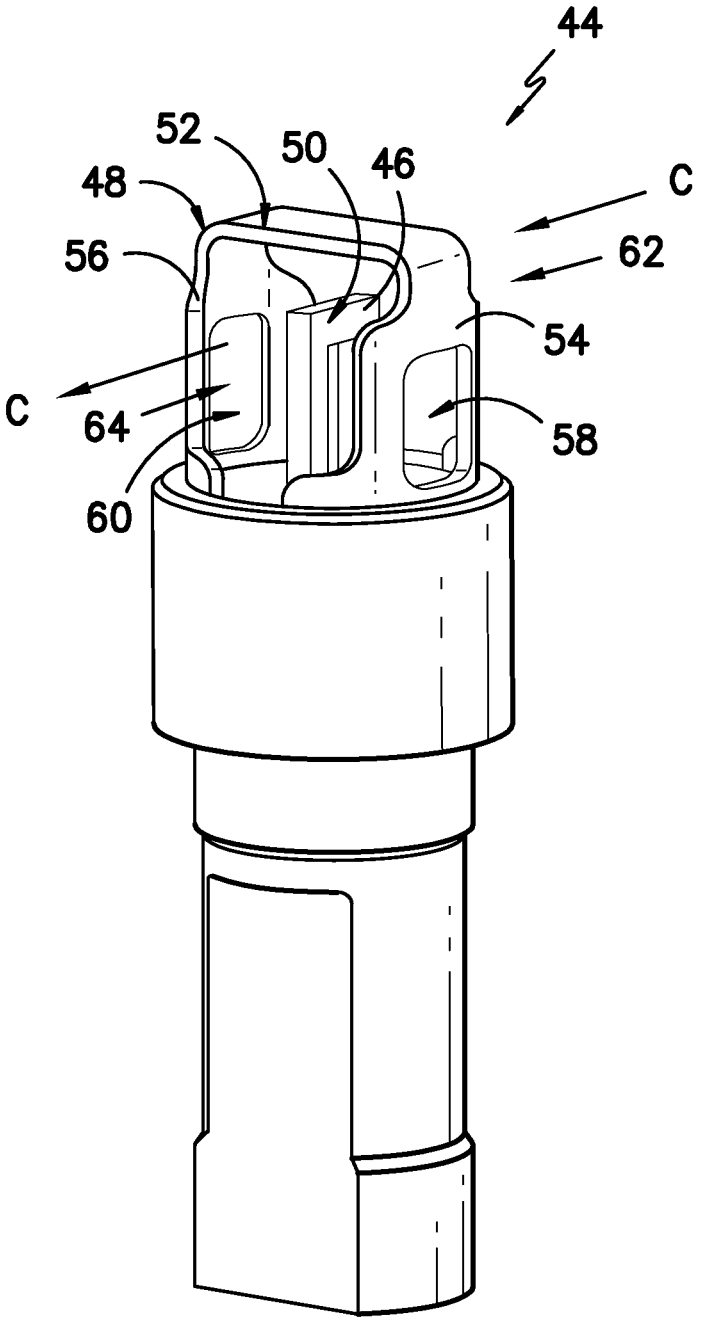
FIG. 4 is a perspective view of a hot surface igniter with a shield according to an exemplary embodiment of the present invention.

The present invention relates to a gas burner assembly having a hot surface igniter. The hot surface igniter is provided with a shield that protects the igniter from e.g., impact or other damage during cleaning or use. The shield is configured with the gas burner in a manner that can minimize the aesthetic impact on the flame while also providing ignition at low and high gas flow rates. Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides an exemplary embodiment of a cook-top appliance 10 of the present invention. Cook-top 10 could be e.g., installed into the cabinetry of a kitchen and could be associated with one or more ovens. Cook-top 10 includes a horizontal surface 12 on which a plurality of gas burner assemblies 14, 16, 18, and 20 are located. Grates 22 and 24 provide support for cooking utensils placed thereon for the heating and cooking of food. Burners 14, 16, 18, and 20 are associated with controls 26, 28, 30, and 32, respectively.

Cook-top 10 is provided by way of example only. The present invention may be used with other cooking appliances having one or more gas burner assemblies. Accordingly, the present invention may be used with a cook-top having e.g., a different number and/or positioning of burners 14, 16, 18, and 20. The present invention may also be used e.g., with a gas range appliance having a cook-top that uses gas burner assemblies. In addition, controls 26, 28, 30 and 32 may be mounted in other configurations and locations other than as shown in FIG. 1. For example, controls 26, 28, 30 and 32 may be positioned on a vertical surface positioned near a front side of cook-top 10 where e.g., the user would be located during operation.

As stated, burners 14, 16, 18, and 20 are associated with controls 26, 28, 30, and 32. More particularly, control 26 allows for the selective adjustment or control of burner 14 in that control 26 can activate or turn on burner 14 as well as control the amount of heat produced by burner 14. In the case of an appliance 10 that is based on gaseous fuel, control 26 is typically associated with a valve (not shown) for control of the gas flow. Similarly, burners 16, 18, and 20 are selectively adjusted by controls 28, 30, and 32. Indicia 34 are provided with each control 26, 28, 30, and 32 to provide a simple indication of the rotatable position of a particular control and, therefore, whether such control is turned on and to what extent.

FIG. 2 provides a perspective view of an exemplary embodiment of one of the gas burner assemblies 16 of the present invention. FIG. 3 provides a side view of burner assembly 16. As shown, gas burner assembly 16 is positioned upon the horizontal surface 12 of cooktop 10 as previously stated. Burner assembly 16 includes a burner body 36 that supports a burner cap 38 placed on top of burner body 36. Burner cap 38 is removable from burner body 36 for maintenance and cleaning Burner body 36 includes a plurality of orifices 40 that are positioned about the circumference of body 36. Orifices 40 are in fluid communication with an internal passage 42 whereby gas is selectively supplied by operation of control 28. When activated, gas mixes with air through passage 42 (as shown by arrow F) and exits orifices 40 (arrows) whereupon the combustible mixture can be ignited by hot surface igniter assembly 44.

FIG. 4 provides a perspective view of an exemplary embodiment of hot surface igniter assembly 44. As shown, assembly 44 includes a hot surface igniter element 46 that is protected by a shield 48. By way of example, igniter element 46 may be constructed from a ceramic material such as a silicon nitride or silicon carbide. Upon application of an appropriate voltage, igniter element 46 becomes hot enough to ignite the mixture of gas and air located near burner 16 when gas is supplied. Typically, hot surface igniter element 46 will be activated at about the same time as gas fuel is provided to burner assembly 16 by manipulating control 26. As shown in FIG. 3, igniter assembly 44 is positioned relative to burner assembly 16 so that hot surface igniter element 46 is located in front of, or immediately adjacent to, one of the orifices 40. Such positioning assists with ensuring that hot surface igniter can ignite the gas mixture over the range of expected flow rates.

Shield 48 includes a planar top surface 52 that extends between a pair of supports 54 and 56, which are located on opposing sides of hot surface igniter 46. For this exemplary embodiment, shield 48 includes apertures 58 and 60, one each located in supports 54 and 56. Gas flows though shield 48 as shown by arrows C. More particularly, surface 52 and supports 54 and 56 define an entrance opening 62 and an exit opening 64 for the ingress and egress of gaseous mixtures through shield 48.

As shown most clearly in FIG. 5, the planar surface 50 of hot surface igniter element 46 is oriented substantially parallel to the flow of gaseous mixture C exiting burner body 36. More specifically, planar surface 50 is perpendicular to a tangent T of the outer circumferential surface 66 of burner cap. Additionally, as shown in FIG. 3, igniter assembly 44 is positioned so that planar top surface 52 is positioned in close proximity to the bottom surface 68 of burner cap 38. For example, in one exemplary embodiment, the distance between the planar top surface 52 and the bottom surface 68 is in the range of about 0.01 to 0.1 inches. As such, the flow of gas as through shield 48 depicted by arrows C is maximized. The positioning of igniter assembly 44 as described herein provides a minimal impact on the aesthetic appearance of the flame created by burner assembly 16 while also ensuring that assembly 44 is best positioned to provide ignition of the gas mixture and optimize the appearance of the flame through igniter assembly 44.

As will be understood by one of skill in the art using the teachings disclosed herein, the present invention is not limited to the particular construction for a burner assembly as shown in the figures and may be used with other constructions as well. For example, the present invention may also be used with a burner assembly where the burner cap and burner body are combined into a unitary construction. The present invention may also be used with burner assemblies of different shapes and configurations. Accordingly, it should be understood that this written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A gas burner assembly for connection to a source of gas, the assembly comprising:

a burner body defining an opening for the flow-through of gas;

a burner cap positioned on top of said burner body, said burner cap defining a bottom surface;

a hot surface igniter positioned adjacent to said burner body and beneath said burner cap; and, a shield positioned over said hot surface igniter, said shield comprising a pair of supports spaced apart and located on opposing sides of said hot surface igniter;

a planar top surface extending between said supports substantially parallel and in close proximity to the bottom surface of said burner cap; and an entrance opening and an exit opening defined by said supports and said planar top surface, said entrance opening positioned opposite said exit opening and defining a plane perpendicular to a gas flow exiting from said burner body, wherein said supports are connected by only said planar top surface.

2. A gas burner assembly as in claim 1, wherein said hot surface igniter defines a planar surface that is parallel to the direction of a gas flow exiting from said burner body.

3. A gas burner assembly as in claim 1, wherein said burner cap defines an outer circumferential surface, and wherein said hot surface igniter defines a planar surface that is perpendicular to a tangent to the outer circumferential surface of said burner cap.

4. A gas burner assembly as in claim 1, wherein said hot surface igniter comprises a ceramic material.

5. A gas burner assembly as in claim 1, wherein the distance between the planar top surface of said shield and the bottom surface of said burner cap is in the range of about 0.01 to 0.1 inches.

6. A gas burner assembly as in claim 1, wherein said burner body defines a plurality of orifices for the flow through of a gaseous fuel, and wherein said hot surface igniter is positioned adjacent to one of said orifices.

7. A gas burner assembly as in claim 1, wherein said hot surface igniter is positioned within said shield so as to maximize the flow volume of the gaseous fuel through the shield.

8. A gas fuel cooking appliance, comprising:

a cook top assembly;

a gas burner positioned on said cook top assembly, said gas burner having a bottom surface;

a hot surface igniter positioned below the bottom surface of said gas burner; and, a shield positioned over said hot surface igniter, said shield comprising a pair of supports spaced apart and located on opposing sides of said hot surface igniter;

a top surface extending between said supports, said top surface positioned immediately below the bottom surface of said gas burner; and an entrance opening and an exit opening defined by said support and said top surface, said entrance opening positioned opposite said exit opening and defining a plane perpendicular to a gas flow exiting from said burner body, wherein said supports are connected by only said top surface.

9. A gas fuel cooking appliance as in claim 8, wherein said gas burner further comprises:

a burner body defining an internal passage in communication with a plurality of orifices positioned around a circumference of said burner body and configured for the flow-through of gas supplied through the internal passage; and a burner cap positioned on top of said burner body, said burner cap defining the bottom surface of said gas burner;

wherein the top surface of said shield is planar and substantially parallel to the bottom surface of said burner cap.

10. A gas fuel cooking appliance as in claim 8, wherein said hot surface igniter defines a planar surface that is parallel to the direction of a gaseous fuel flow exiting from said burner body.

11. A gas fuel cooking appliance as in claim 8, wherein said burner cap defines an outer circumferential surface, and wherein said hot surface igniter defines a planar surface that is perpendicular to a tangent to the outer circumferential surface of said burner cap.

12. A gas fuel cooking appliance as in claim 8, wherein the distance between the top surface of said shield and the bottom surface of said burner cap is in the range of about 0.01 to 0.1 inches.

13. A gas fuel cooking appliance as in claim 8, wherein said burner body defines a plurality of orifices for the flow through of a gaseous fuel, and wherein said hot surface igniter is positioned adjacent to one of said orifices.

14. A gas fuel cooking appliance as in claim 8, wherein said hot surface igniter is positioned within said shield so as to maximize the hydraulic diameter of the gaseous fuel through the shield.

15. A method for protecting a hot surface igniter, comprising the steps of:

providing a gas burner assembly for connection to a source of gas, the gas burner assembly comprising a burner body defining an opening for the flow-through of gas;

a burner cap positioned on top of the burner body, the burner cap defining a bottom surface;

a hot surface igniter element positioned adjacent to the burner body and beneath the burner cap; and, a shield positioned over the hot surface igniter, the shield defining a planar top surface substantially parallel to the bottom surface of the burner cap;

a pair of supports spaced apart and located on opposing sides of said hot surface igniter, the supports connected by only the planar top surface; and an entrance opening and an exit opening, the entrance opening positioned opposite said exit opening and defining a plane perpendicular to a gas flow exiting from said burner body; and, positioning the planar top surface of the shield in close proximity to the burner cap so as to maximize the area for flow of gas past the hot surface igniter element and minimize the disturbance of the gas mixture flow through the shield.

16. A gas burner assembly as in claim 1, wherein each support defines an aperture therein.

17. A gas burner assembly as in claim 1, wherein said burner cap defines an outer circumferential surface, and wherein said planar top surface does not extend beyond said outer circumferential surface.

18. A gas burner assembly as in claim 1, wherein said entrance opening and said exit opening extend from a base of each support to said planar top surface.

19. A gas burner assembly as in claim 1, wherein said burner cap defines an outer circumferential surface, and wherein said supports do not extend beyond said outer circumferential surface.

* * * * *